US007926772B2

(12) United States Patent
Lowe et al.

(10) Patent No.: US 7,926,772 B2
(45) Date of Patent: Apr. 19, 2011

(54) BATHROOM FIXTURE ATTACHMENT DEVICE INCLUDING A ROTARY COUPLING

(75) Inventors: Mark Jeffrey Lowe, Bossier City, LA (US); Kenny Lavelle Miller, Shreveport, LA (US)

(73) Assignee: Hardware Resources, Inc., Bossier City, LA (US)

( * ) Notice: Subject to any disclaimer, the term of this patent is extended or adjusted under 35 U.S.C. 154(b) by 31 days.

(21) Appl. No.: 12/079,318

(22) Filed: Mar. 26, 2008

(65) Prior Publication Data

US 2009/0242713 A1 Oct. 1, 2009

(51) Int. Cl.
*A47B 96/00* (2006.01)

(52) U.S. Cl. ..... 248/222.14; 248/220.21; 248/222.13

(58) Field of Classification Search ..... 248/221.11, 248/222.14, 222.13, 222.51, 222.52
See application file for complete search history.

(56) References Cited

U.S. PATENT DOCUMENTS

| | | | | | |
|---|---|---|---|---|---|
| 1,181,336 | A | | 5/1916 | Mutton | |
| 1,276,463 | A | | 8/1918 | Wells | |
| 1,799,558 | A | | 4/1931 | Howard | |
| 1,838,935 | A | * | 12/1931 | Fixsen | 248/222.52 |
| 1,893,729 | A | | 1/1933 | Call | |
| 2,992,323 | A | * | 7/1961 | Fletcher | 362/306 |
| 3,600,735 | A | * | 8/1971 | Jerabek | 15/49.1 |
| 3,888,156 | A | | 6/1975 | Fima | |
| 3,985,417 | A | * | 10/1976 | Fenton | 439/334 |
| 4,102,529 | A | | 7/1978 | Neblung et al. | |
| 4,223,861 | A | * | 9/1980 | Guggemos et al. | 248/222.52 |
| 4,240,129 | A | * | 12/1980 | Kawazoe | 362/3 |
| 4,286,497 | A | | 9/1981 | Shamah | |
| 4,349,940 | A | * | 9/1982 | Fleischmann et al. | 16/110.1 |
| 4,439,079 | A | | 3/1984 | Losada | |
| 4,458,872 | A | | 7/1984 | Couch | |
| 4,498,654 | A | | 2/1985 | Cooper | |
| 4,529,157 | A | * | 7/1985 | Suman et al. | 248/291.1 |
| 4,573,844 | A | | 3/1986 | Smith | |
| 4,645,286 | A | * | 2/1987 | Isban et al. | 439/571 |
| 4,659,119 | A | | 4/1987 | Reimert | |
| 4,915,343 | A | | 4/1990 | Terlecke | |
| 4,934,859 | A | | 6/1990 | Dixon et al. | |
| 4,979,713 | A | * | 12/1990 | Bell | 248/224.8 |
| 4,998,701 | A | * | 3/1991 | Rawald | 248/224.7 |
| 5,007,223 | A | | 4/1991 | Holland | |
| 5,290,974 | A | | 3/1994 | Douglas et al. | |

(Continued)

FOREIGN PATENT DOCUMENTS

EP 1 019 640 A1 7/2000

(Continued)

*Primary Examiner* — Terrell Mckinnon
*Assistant Examiner* — Erin Smith
(74) *Attorney, Agent, or Firm* — Schultz & Associates, P.C.

(57) ABSTRACT

The invention disclosed provides a rotary coupling mechanism that securely attaches common household fixtures to a wall. The invention is comprised of a wall bracket, a base bracket, a cam pin, and two mounting screws. Flanges on the base bracket rotationally engage flanges on the wall bracket and the cam pin inserted through the base bracket rotates to hold the flanges and secure the base bracket to the wall bracket. An alternate embodiment of the invention is comprised of a wall bracket and a base bracket having flanges with canted surfaces. A locking pin holds the brackets together after the flanges are rotationally engaged. For each application of the coupling mechanism, a decorative body conceals the apparatus. The decorative body is rigidly connected or pivotally connected to a decorative cap. The decorative cap retains various household fixtures such as paper holders, towel racks, or shelves.

14 Claims, 11 Drawing Sheets

U.S. PATENT DOCUMENTS

| | | | | |
|---|---|---|---|---|
| 5,509,765 | A | 4/1996 | Albin | |
| 5,875,903 | A | 3/1999 | Chen | |
| 5,931,427 | A | 8/1999 | Pan | |
| 6,019,233 | A | 2/2000 | Yu | |
| 6,099,054 | A | 8/2000 | Glass et al. | |
| 6,113,045 | A * | 9/2000 | Kuo | 248/222.14 |
| 6,318,941 | B1 | 11/2001 | Guenther | |
| 6,345,945 | B1 | 2/2002 | Hildebrandt | |
| 6,371,423 | B1 * | 4/2002 | Miller | 211/123 |
| 6,810,538 | B2 * | 11/2004 | Ouyoung | 4/576.1 |
| 6,863,465 | B2 | 3/2005 | Brancheriau | |
| 6,893,199 | B2 | 5/2005 | Michels | |
| 7,052,224 | B2 | 5/2006 | Venus et al. | |
| 7,108,607 | B2 | 9/2006 | Swim, Jr. | |
| 7,111,336 | B1 * | 9/2006 | Lai | 4/576.1 |
| 7,597,297 | B2 * | 10/2009 | Isfeld et al. | 248/251 |
| 2002/0074301 | A1 | 6/2002 | Lai | |
| 2002/0088764 | A1 | 7/2002 | Pan | |
| 2002/0104946 | A1 * | 8/2002 | Lai | 248/316.8 |
| 2004/0208722 | A1 | 10/2004 | Kuenzel | |
| 2006/0022098 | A1 | 2/2006 | De Backer | |
| 2006/0043039 | A1 | 3/2006 | Garrett | |
| 2007/0269263 | A1 | 11/2007 | Rotshtain | |
| 2007/0274772 | A1 | 11/2007 | Tiberghien et al. | |

FOREIGN PATENT DOCUMENTS

| | | |
|---|---|---|
| JP | 2002-233472 | 8/2002 |
| WO | WO00/25030 | 5/2000 |
| WO | WO2007/005345 A2 | 1/2007 |

* cited by examiner

BATHROOM FIXTURE ATTACHMENT DEVICE INCLUDING A ROTARY COUPLING

FIELD OF THE INVENTION

The present invention relates to a coupling mechanism. In particular, the invention relates to a rotary coupling mechanism secured to a wall and used to support various decorative and functional fixtures in a household.

BACKGROUND OF THE INVENTION

In the prior art, kitchen and bathroom fixtures such as paper holders, shelves and towel rods are secured to vertical walls with mounting devices made of various compositions. Generally, the walls are drywall or sheetrock and in some cases include a tile or stone façade. The prior art mounting devices are generally comprised of two pieces. The first piece usually includes a flat plate having angled flanges affixed to the wall with screws or bolts. The second piece is usually a decorative cover affixed to the plate through the use of set screws. The set screws thread through the lower plate and engage the angled flanges. The typical prior art mounting devices are unacceptable because many times, the set screws are small, making them difficult to adjust. Also, the set screws are generally incapable of bearing the load required because of their small size and therefore, are prone to becoming loose and ultimately dislodging from the wall.

Typical of the prior art is U.S. Pat. No. 4,979,713 to Bell. Bell discloses a towel rack mounting device that includes a triangular bracket designed to be mounted on a wall. The bracket has three flanges oriented in a triangular array. The circular base is locked onto the bracket by threading a set screw through the wall of the circular base and into contact with one of the flanges. The remaining flanges engage a groove on the base. The set screw applies pressure to an angled surface which tends to move the circular base and the bracket away from the wall.

U.S. Pat. No. 5,875,903 to Chen discloses a bathroom hanger rack that incorporates a bracket mounted to the wall having an interiorly threaded cylindrical post extending from the wall. A decorative casing is secured to the post with a threaded attachment. A rod extends between two decorative casings and a decorative cap is threaded to the top of each casing.

U.S. Patent Application No. 2002/0088764 to Pan discloses a towel rack comprised of two fastening bases, two retaining heads, and a towel rod. Each fastening base includes a post having two recessed grooves. A first set screw holds the towel rod in a retaining head. A second set screw secures the retaining head to the post extending from the fastening base. The towel rod must be secured to each retaining head before securing the retaining heads to their respective fastening bases. The use of one laterally opposed set screw tends to tilt the retaining head away from the wall and therefore is prone to becoming loose.

U.S. Patent Application No. 2002/0104946 to Lai discloses a structure for holding a towel rack and the like. Two stanchions are included. Each includes a base, a disk, a decorative cover, and a head. Each base is fastened to the wall. Each base includes a center post with an angled notch. The disk covers the base, and the decorative cover engages the disk with tabs. The head engages the decorative cover through additional tabs and is provided with a hole for retaining the towel rod. The center post of the base extends through the disk, the decorative cover, and into the head. A single set screw through the head engages the angled notch in the post and presses the head, the decorative cover, and the disk to the base. The same potential problems exist with the set screw.

SUMMARY OF INVENTION

The preferred embodiment of the present invention provides a rotary coupling mechanism that securely attaches common household fixtures to a wall. The invention allows the fixtures to be mounted quickly and easily to the wall and further conceals all mounting hardware. The invention is designed to not distract from the decorative features of the fixtures and can be used with various fixtures common to a bathroom or kitchen such as paper holders, towel rods, or shelves. Depending on the specific fixture to be mounted, more than one rotary coupling mechanism may be required.

Accordingly, an embodiment of the present invention provides a rotary coupling mechanism for mounting a pivoting paper holder to a wall. The pivoting paper holder has two mounting points and thus includes two rotary coupling mechanisms. Each coupling mechanism includes a wall bracket, a base bracket, a cam pin, and a pair of mounting screws. Horizontal flanges on the base bracket rotationally engage horizontal flanges on the wall bracket. A turn of the cam pin forces the wall bracket and the base bracket together and prevents separation. Each coupling mechanism is concealed by a decorative body and a decorative cap. The decorative body is connected to the base bracket. A shoulder bolt pivotally connects the decorative body to the decorative cap. A nylon bushing between the body and the cap eases rotation by preventing metal to metal contact. A second shoulder bolt and a pair of dowels rigidly connect a second decorative body to a second decorative cap preventing rotation of the cap relative to the body. The first decorative cap pivots and holds a rod while the second decorative cap remains stationary and holds a catch with which the rod cooperates.

An alternate embodiment of the rotary coupling mechanism incorporates a wall bracket and a base bracket each having slanted surfaces on the flanges. A locking pin is mounted on the base bracket in a position which allows its rotation. As the base bracket is rotated on the wall bracket the angled surfaces on the flanges pull the base bracket towards the wall bracket. The locking pin rotates into a mechanical locking position which locks the base bracket and wall bracket together. The base bracket is connected to the decorative cap which conceals the device.

Those skilled in the art will further appreciate the above-mentioned features and advantages of the invention together with other important aspects upon reading the detailed description that follows in conjunction with the drawings.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
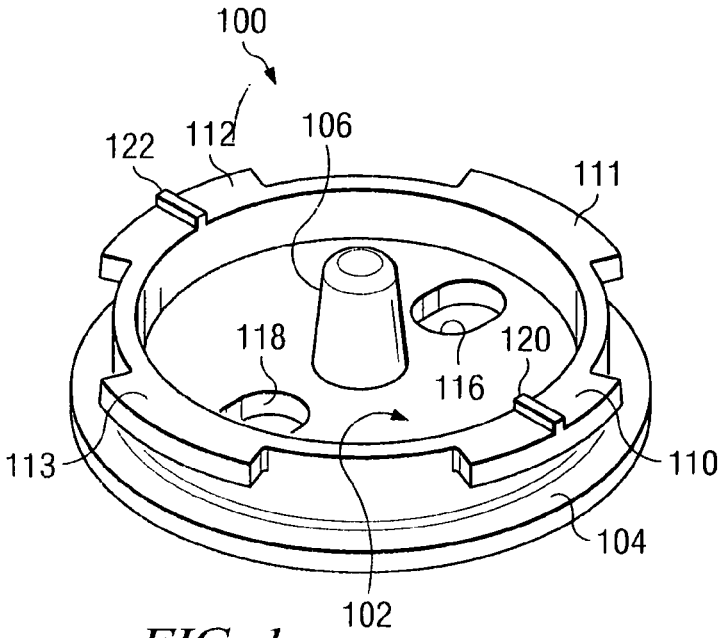
FIG. 1 is an isometric view of a wall bracket of a preferred embodiment of the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
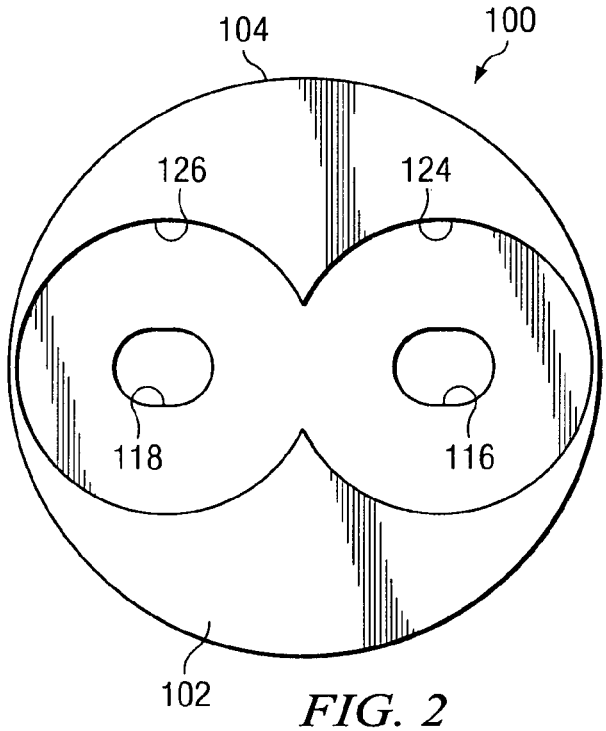
FIG. 2 is a plan view of the underside of a wall bracket of a preferred embodiment of the present invention.

FIGS. 1 and 2 show wall bracket 100. Wall bracket 100 is generally cylindrical in shape. Wall bracket 100 is enclosed on one end by base 102. Base 102 extends past the cylindrical wall of wall bracket 100 to form lip 104. Flanges 110, 111, 112, and 113 extend outwardly from the open end of wall bracket 100. In the preferred embodiment, flanges 110, 111, 112, and 113 are spaced at 90° intervals around wall bracket 100 and each occupies between about 40° and 45° of the perimeter of wall bracket 100. Wall bracket 100 further includes a centrally located boss 106 which extends from the center of base 102. Two diametrically opposed oblong openings, mounting holes 116 and 118, flank boss 106. Spacers 120 and 122 are protrusions located on flanges 110 and 112 respectively. Semicircular indentions 124 and 126 are oblong and concentrically centered around mounting holes 116 and 118, respectively. Semicircular indentions 124 and 126 are located on the underside of base 102 and are roughly half the depth of base 102.

Figure 3:
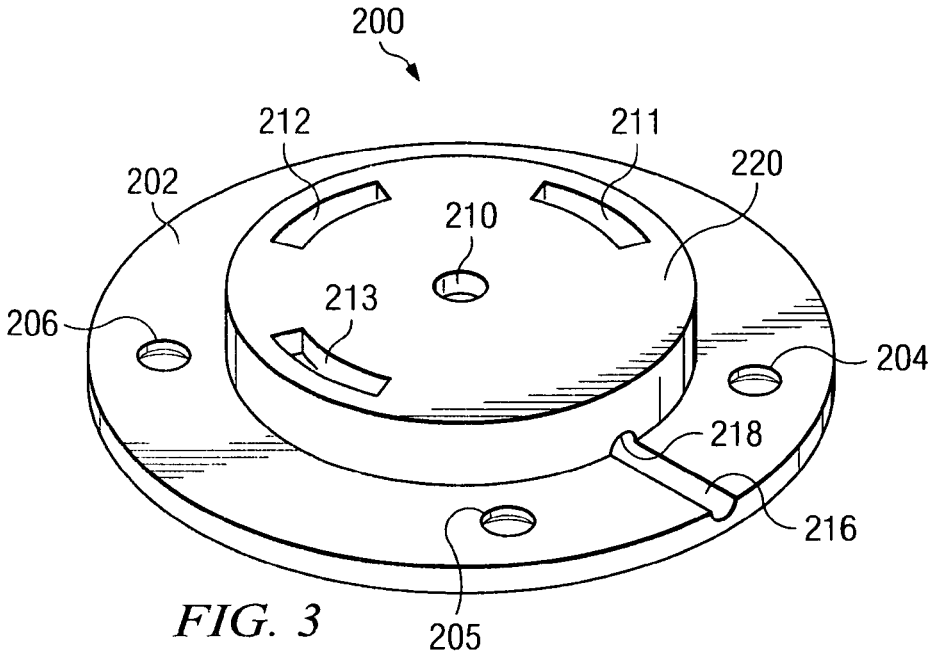
FIG. 3 is an isometric view of a base bracket of a preferred embodiment of the present invention.
Figure 4:
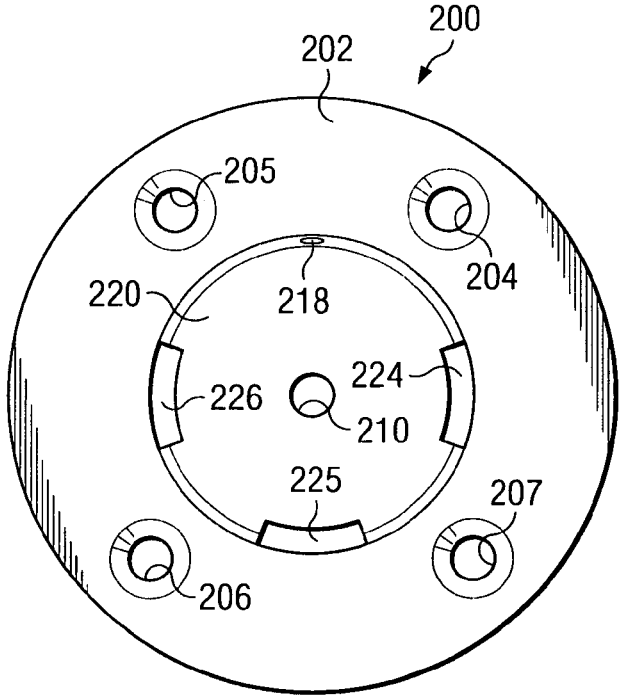
FIG. 4 is a plan view of the underside of a base bracket of a preferred embodiment of the present invention.

Referring to FIGS. 3 and 4, there is shown base bracket 200. Base bracket 200 is generally cylindrical in shape and is enclosed on one end by base housing 220. Lip 202 extends outwardly from the open end of base bracket 200. Included on lip 202 are base holes 204, 205, 206, and 207. Base holes 204, 205, 206, and 207 are circular in shape and each includes a beveled perimeter on the underside of lip 202. Cam channel 216 is a radially extending semicircular groove in the top side of lip 202 which leads to cam hole 218. Cam hole 218 extends to the interior of base bracket 200. Hole 210 is concentrically aligned with base housing 220. Slots 211, 212, and 213 are arcuate holes through base housing 220. Slots 211, 212, and 213 are located 90° from each other with slots 211 and 213 being diametrically opposed along the perimeter of base housing 220. Located in alignment with slots 211, 212, and 213 are base flanges 224, 225, and 226 respectively. Base flanges 224, 225, and 226 extend perpendicularly from the interior of base bracket 200 towards hole 210. Each flange occupies between about 35° and 40° of the circular shape of base bracket 200.

In the preferred embodiment, wall bracket 100 and base bracket 200 are typically constructed of cast aluminum or zinc alloy, but can also be formed of injection molded plastic or nylon.

Figure 5:
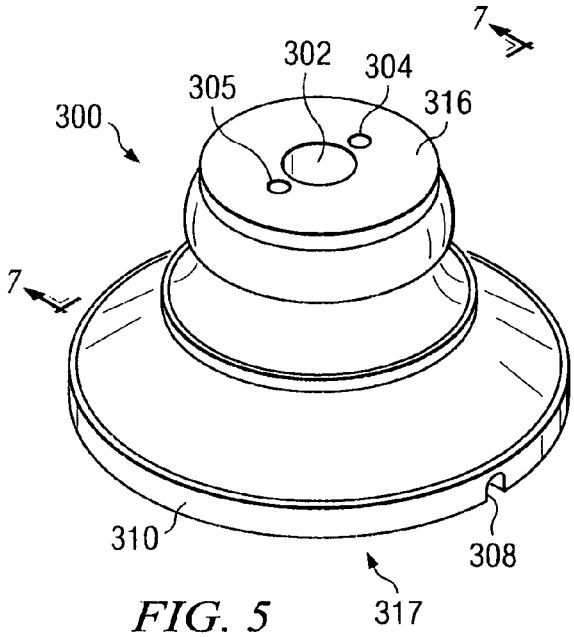
FIG. 5 is an isometric view of a decorative body of a preferred embodiment of the present invention.
Figure 6:
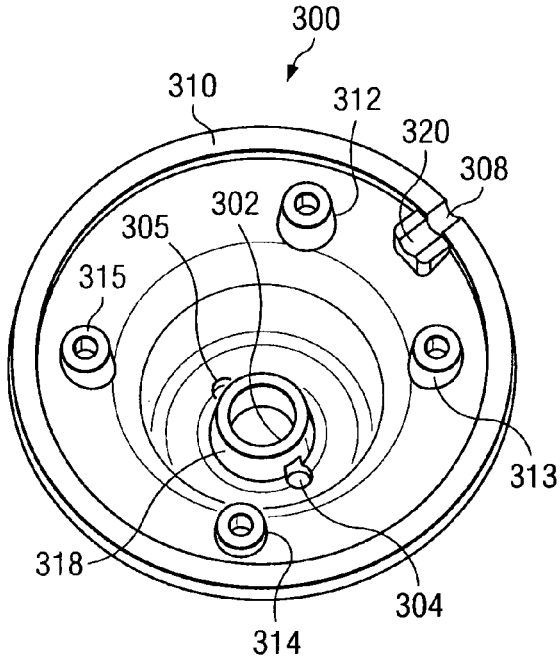
FIG. 6 is an isometric view of the underside of a decorative body of a preferred embodiment of the present invention.
Figure 7:
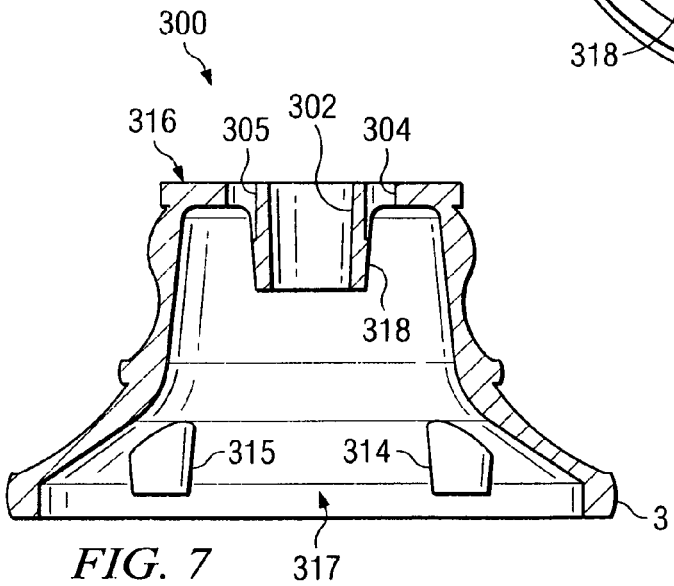
FIG. 7 is an elevation view of a decorative body along line 7-7 of FIG. 5 of a preferred embodiment of the present invention.

FIGS. 5, 6, and 7 show body 300. In the preferred embodiment, body 300 is a hollow "bell shaped" decorative cover including flattened enclosed top 316 and an open end 317. Other shapes of course will function as well. Flattened top 316 includes bushing hole 302 and two diametrically opposed dowel holes 304 and 305 flanking bushing hole 302. Collar 318 defines the circular shape of bushing hole 302. Collar 318 is a hollow cylinder shape extending from the underside of flattened top 316 toward the interior of body 300. The perimeter of open end 317 is surrounded by brim 310. Brim 310 includes cam slot 308. Cam slot 308 provides an opening through brim 310 and cam support 320 extends cam slot 308 into the interior of body 300. The interior of body 300 also includes stanchions 312, 313, 314, and 315. Stanchions 312, 313, 314, and 315 define circular holes used for mounting body 300 to base bracket 200.

Figure 8:
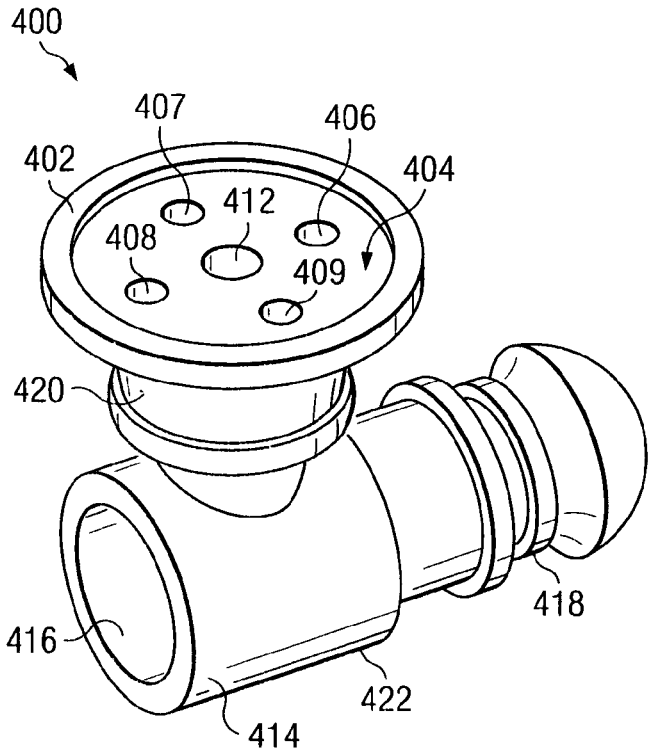
FIG. 8 is an isometric view of a decorative cap of a preferred embodiment of the present invention.
Figure 9:
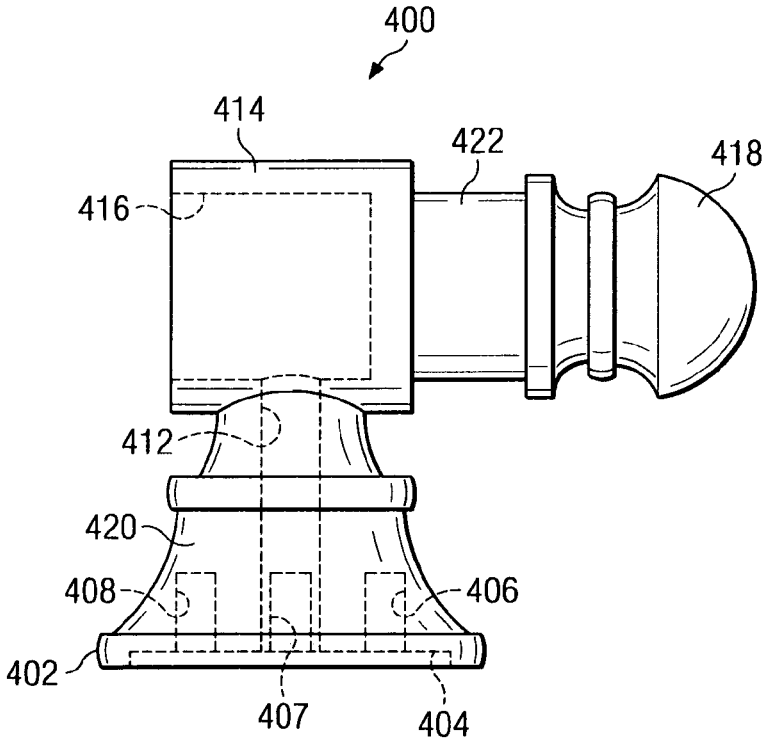
FIG. 9 is an elevation view of a decorative cap of a preferred embodiment of the present invention.

Referring to FIGS. 8 and 9, cap 400 is shown. Cap 400 is an integrally formed decorative piece having an elbow shape. Cap arm 422 is configured to fit perpendicularly with cap base 420 to form the elbow shape. Cap arm 422 includes a solid decorative end 418. In the preferred embodiment, end 418 is generally cylindrical including varying aesthetic shapes, but other designs may also be employed. Opposite end 418, cap arm 422 also includes catch receiver 414. Catch receiver 414 includes catch hole 416. Cap base 420 is generally bell shaped and includes various aesthetic designs. In alternate embodiments, cap base 420 may be other shapes such as spheres, pyramids, or cubes and include varying rings and slopes for decorative effect. Cap base 420 includes cylindrical indention 404, bolt hole 412, and dowel holes 406, 407, 408, and 409. Cylindrical indention 404 is a circular shaped space on one end of cap base 420 defined by brim 402. Bolt hole 412 is concentrically aligned with cap base 420 and cylindrical indention 404. Bolt hole 412 creates a cylindrical channel through cap base 420 and into the interior of catch receiver 414. Dowel holes 406, 407, 408, and 409 are four cylindrical shaped cavities extending from cylindrical indention 404 toward cap arm 422.

Figure 10A:
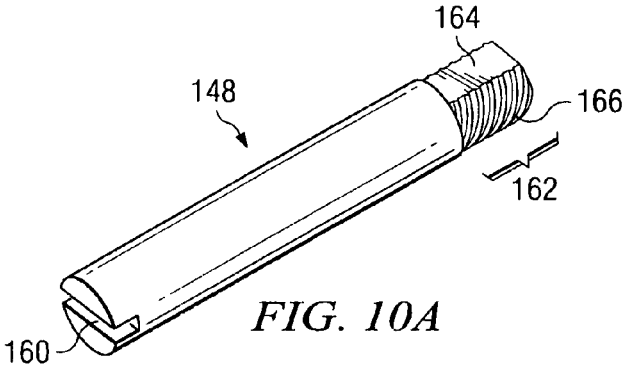
FIG. 10A is an isometric view of a cam pin of a preferred embodiment of the present invention.

Referring FIG. 10A, cam pin 148 is shown. Cam pin 148 is a cylindrical rod having a tool receptacle 160 on one end and cam surface 162 on the opposite end. Tool receptacle 160 may be formed to receive a flathead, a crosshead, a hex key or any such similar type driver capable of applying a torsional force to cam pin 148. Cam surface 162 is die cut to include teeth 166. In the preferred embodiment, teeth 166 are generally perpendicular to the longitudinal axis of cam pin 148 but may also have a helical pattern. Cam surface 162 further includes two diametrically opposed and parallel flat surfaces 164. In the preferred embodiment, cam pin 148 is made of stainless steel but can also be made of other metals or alloys with similar rigid properties.

Figure 10B:
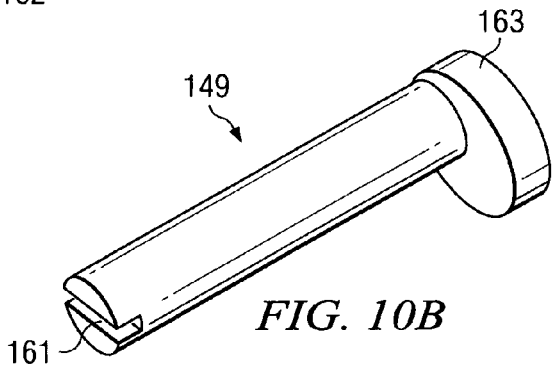
FIG. 10B is an isometric view of a cam pin of an alternate preferred embodiment of the present invention.

FIG. 10B shows an alternate embodiment of the cam pin. Cam pin 149 is also a cylindrical shaft and has receptacle 161 on one end and cam surface 163 on the opposite end. Receptacle 161 is shaped to receive a torque applying tool. Cam surface 163 is an oval shaped cam eccentrically positioned with respect to the longitudinal axis of cam pin 149.

Figure 11:
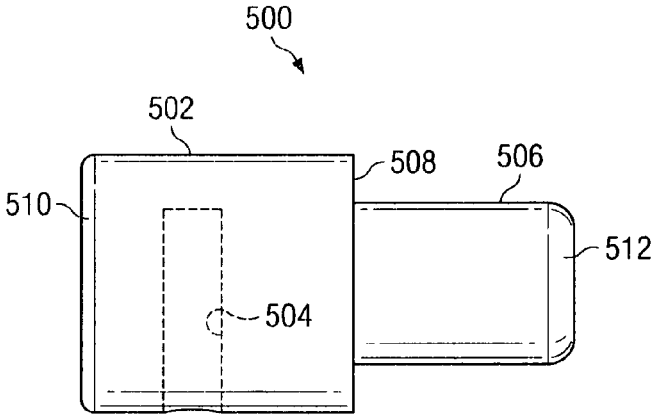
FIG. 11 is an elevation view of an insert of a preferred embodiment of the present invention.

FIG. 11 shows insert 500. Insert 500 is an integrally formed solid piece comprising of two cylindrical shapes, body 502 and catch 506, adjacent to each other. Catch 506 is concentrically aligned with body 502 and has a diameter which is less than the diameter of body 502. The different diameters of body 502 and catch 506 create shoulder 508 located where body 502 and catch 506 meet. Body 502 has a diameter slightly less than catch hole 416. Body 502 is sized to fit into catch hole 416. Body 502 includes a canted edge bevel 510. Body 502 further includes bolt hole 504. Bolt hole 504 is a cylindrical channel perpendicular to the central axis of insert 500. Bolt hole 504 is threaded to receive shoulder bolt 150. Catch 506 includes a canted edge bevel 512.

Figure 12:
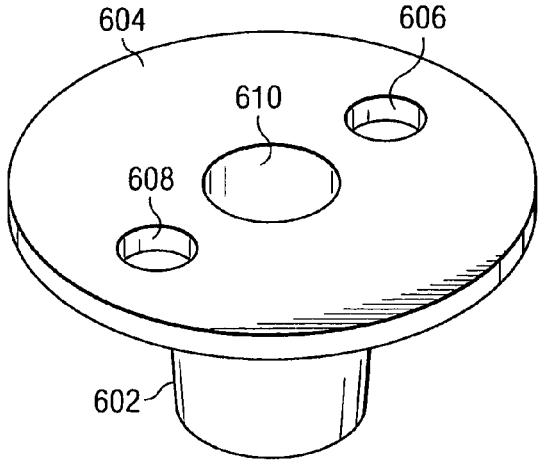
FIG. 12 is an isometric view of a bushing of a preferred embodiment of the present invention.

Referring to FIG. 12, bushing 600 is shown. In the preferred embodiment, bushing 600 is made of nylon and is comprised of a hollow cylindrical shaped hub 602 and an adjacent flat disk shaped seat 604. Hub 602 and seat 604 are integrally formed and their circular shapes are concentrically aligned. Hub 602 has a diameter slightly smaller than bushing hole 302 in order to be received by bushing hole 302. Seat 604 has a diameter slightly smaller than the interior diameter of brim 402 in order to be seated in cylindrical indention 404. Bolt hole 610 is a cylindrical channel with a diameter slightly larger than shoulder bolt 150 and is concentrically aligned with seat 604. Bolt hole 610 passes through seat 604 and the entire length of hub 602. Two diametrically opposed holes, dowel holes 606 and 608, pass through seat 604 and flank bolt hole 610.

In the preferred embodiment, body 300, cap 400, insert 500, and rod 700 are typically cast from of a lightweight metal alloy including aluminum, copper, zinc, or brass and but can also be made of injection molded plastic or nylon, or with other methods and materials known in the art.

Figure 13:
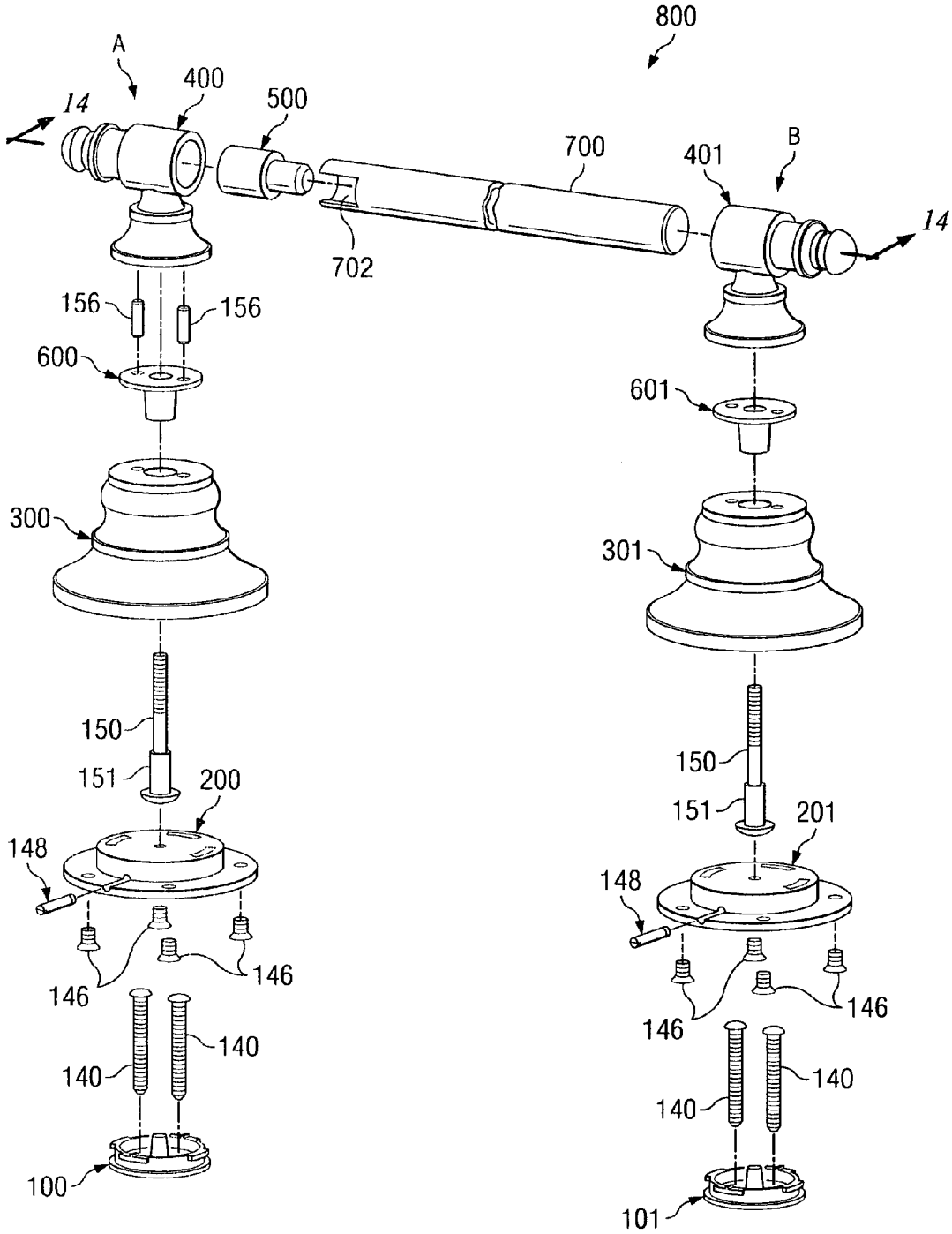
FIG. 13 is an exploded isometric view of a preferred embodiment of the present invention.
Figure 14:
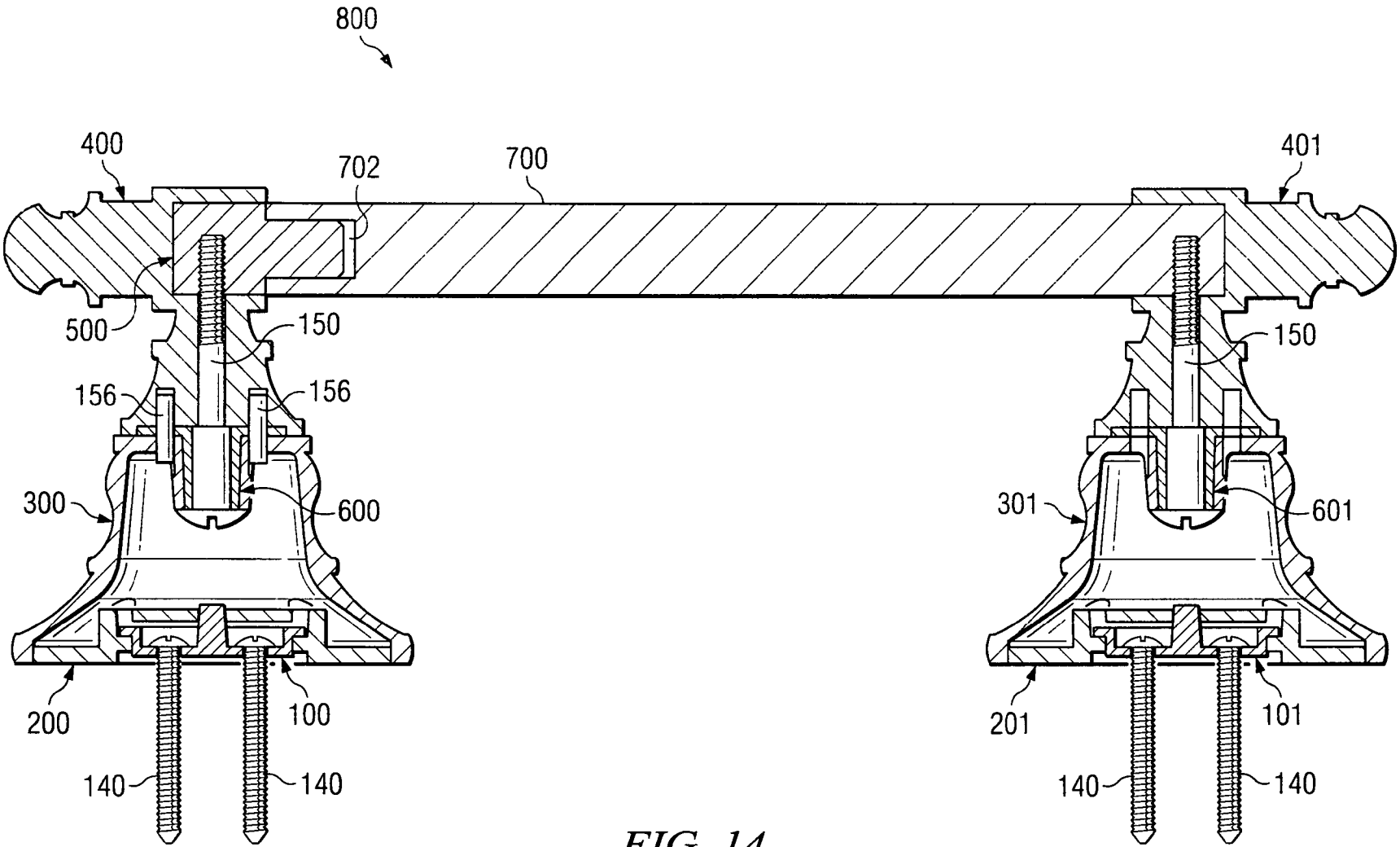
FIG. 14 is an elevation view of a preferred embodiment of the present invention along line 14-14 of FIG. 13.

FIGS. 13 and 14 show the coupling mechanism assembled with a pivoting paper holder 800. In addition to the previously described parts, FIG. 13 also shows mounting screws 140, flat head screws 146, shoulder bolt 150, dowels 156, and rod 700. Rod 700 may be solid or hollow. Rod 700 includes notch 702. Notch 702 is located in one end of rod 700 sufficient in size to receive catch 506 of insert 500. FIGS. 13 and 14 additionally show wall bracket 101, base bracket 201, body 301, bushing 601, and cap 401. Wall bracket 101, base bracket 201, body 301, bushing 601, and cap 401 are identical in size, shape and material to their respective counterparts wall bracket 100, base bracket 200, body 300, bushing 600, and cap 400.

In use, mounting screws 140 securely attach both wall brackets 100 and 101 to the wall or mounting surface. The voids surrounding mounting holes 116 and 118 created by semicircular indentions 124 and 126 allow the material of the wall brackets to deform toward the wall slightly during the tightening of mounting screws 140, thus preventing warping of the perimeter of the wall mount during installation and encouraging a flush mount. For the non-rotating side of paper holder ("A"), bushing 600 is inserted into bushing hole 302 of body 300 and dowels 156 are inserted in dowel holes 606 and 608 of bushing 600. Cap 400 is placed on bushing 600 and dowels 156 are inserted into two diametrically opposed dowel holes. Depending on the desired final orientation of body 300, where cam slot 308 is inconspicuous, either dowel holes 406 and 408 or dowel holes 407 and 409 are used. Insert 500 is placed inside catch hole 416 of cap 400 and bolt hole 504 is aligned with bolt hole 412. Shoulder bolt 150 is inserted through open end 317 of body 300, through bolt hole 610, through bolt hole 412, and finally into the threaded bolt hole 504. Shoulder 151 on shoulder bolt 150 abuts cap 400 and thereby fixes the distance between cap 400 and body 300. The dowels prevent cap 400 from rotating with respect to body 300. As can be seen from FIG. 14, dowels 156 are in contact with cap 400, bushing 600, and body 300.

Base bracket 200 is secured to body 300 with flat head screws 146 inserted through base holes 204, 205, 206, and 207 and into stanchions 312, 313, 314, and 315 of body 300. The base bracket, complete with attached body 300 and cap 400, is placed over wall bracket 100 and base flanges 224, 225, and 226 of base bracket 200 are oriented to pass between flanges 110, 111, 112, and 113 of wall bracket 100 until base housing 220 abuts spacers 120 and 122. Base bracket 200 is rotated until the three base flanges of base bracket 200 are positioned under and adjacent to three of the flanges of wall bracket 100. The width of the flanges and the width of the base flanges overlap sufficiently to allow up to about 15° of axial rotational adjustment between wall bracket 100 and base bracket 200 without compromising the integrity of the connection. The width of the flanges ensures the contact surfaces between the flanges remains adequate to securely hold wall bracket 100 to base bracket 200. The rotational adjustment allows the fixture to be properly aligned without requiring the wall bracket to be removed and remounted at a different orientation. The rotational freedom is a great advantage over the prior art which all requires exact placement of the mounting holes for correct placement of the final assembly.

Once the base bracket, complete with attached body 300 and cap 400, are oriented to the desired position, cam pin 148 is inserted into cam slot 308. Cam channel 216 and cam support 320 guides cam pin 148 through cam hole 218 until cam pin 148 abuts wall bracket 100. Flat surfaces 164 of cam pin 148 simultaneously engage the fourth flange of wall bracket 100 and lip 104. Cam pin 148 is rotated about ¼ of a turn in either direction. Teeth 166 of cam surface 162 simultaneously engage the fourth flange of wall bracket 100 and lip 104 securing wall bracket 100 to base bracket 200. If necessary, cam pin 148 can be released and the orientation of the base bracket can be adjusted. The engagement of the teeth with the wall bracket and lip prevent movement of the base bracket with respect to the wall bracket. In an alternate embodiment, cam pin 149 is rotated about ¼ of a turn to engage the off-center cam surface 163 with the fourth flange of wall bracket 100 and lip 104. Friction is created which secures the base bracket to the wall bracket.

For the rotating side of the paper holder "B", bushing 601 is inserted into the bushing hole of body 301 and dowels 156 are purposely omitted in order to allow rotation of the cap with respect to the body. Cap 401 is placed adjacent to bushing 601 and is concentrically aligned with both bushing 601 and body 301. Rod 700 is positioned inside the catch hole of cap 401. A shoulder bolt 150 is inserted through body 301, through bushing 601, through cap 401 and finally into a threaded bolt hole in rod 700. Shoulder 151 on shoulder bolt 150 abuts cap 401 and prevents over tightening of shoulder bolt 150 while still allowing rotation of cap 401 with respect to body 301.

Base bracket 201, complete with attached body 301 and cap 401 with rod 700, is placed over wall bracket 101. Base bracket 201 is rotated until the three base flanges of base bracket 201 become adjacent to three of the flanges of wall bracket 101. Once the base bracket is rotated to the desired position, a cam pin is inserted into the cam slot on body 301. The cam pin is rotated about ¼ of a turn in either direction to secure wall bracket 101 to base bracket 201.

Figure 15:
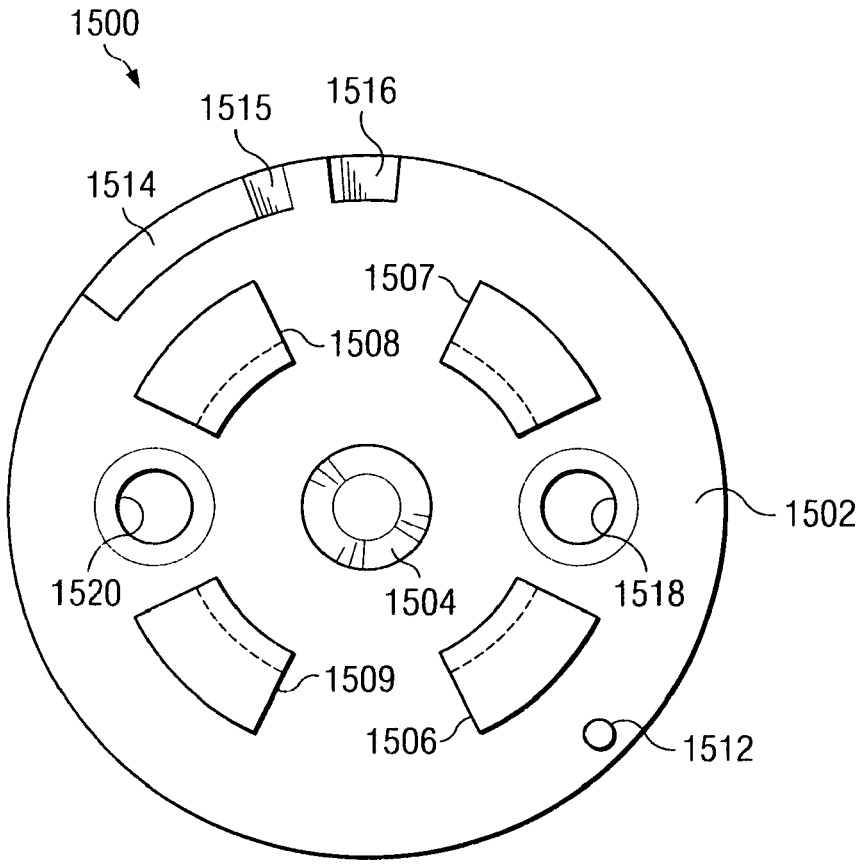
FIG. 15 is a plan view of a wall bracket of an alternate preferred embodiment of the present invention.
Figure 16:
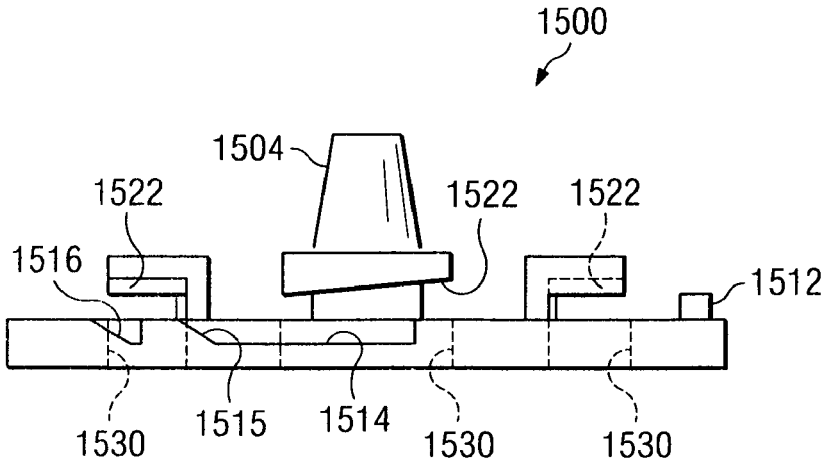
FIG. 16 is an elevation view of a wall bracket of an alternate preferred embodiment of the present invention.
Figure 17:
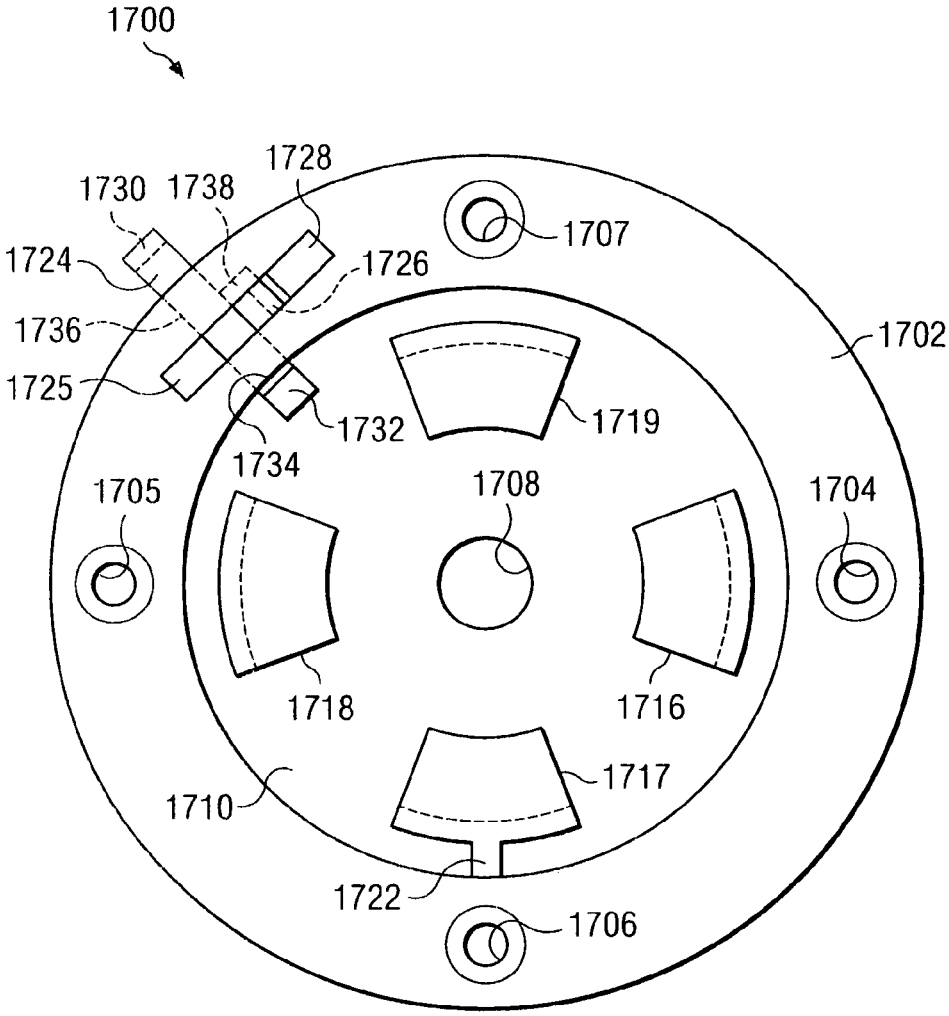
FIG. 17 is a plan view of a base bracket of an alternate preferred embodiment of the present invention.
Figure 18:
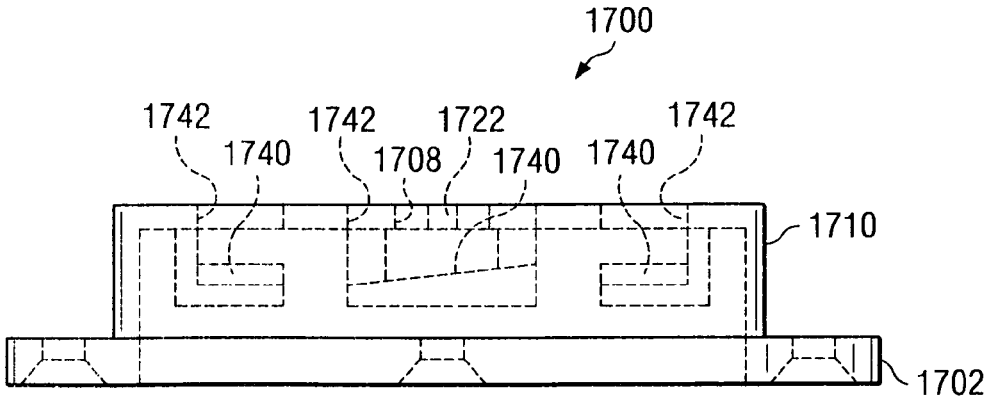
FIG. 18 is an elevation view of a base bracket of an alternate preferred embodiment of the present invention.
Figure 19:
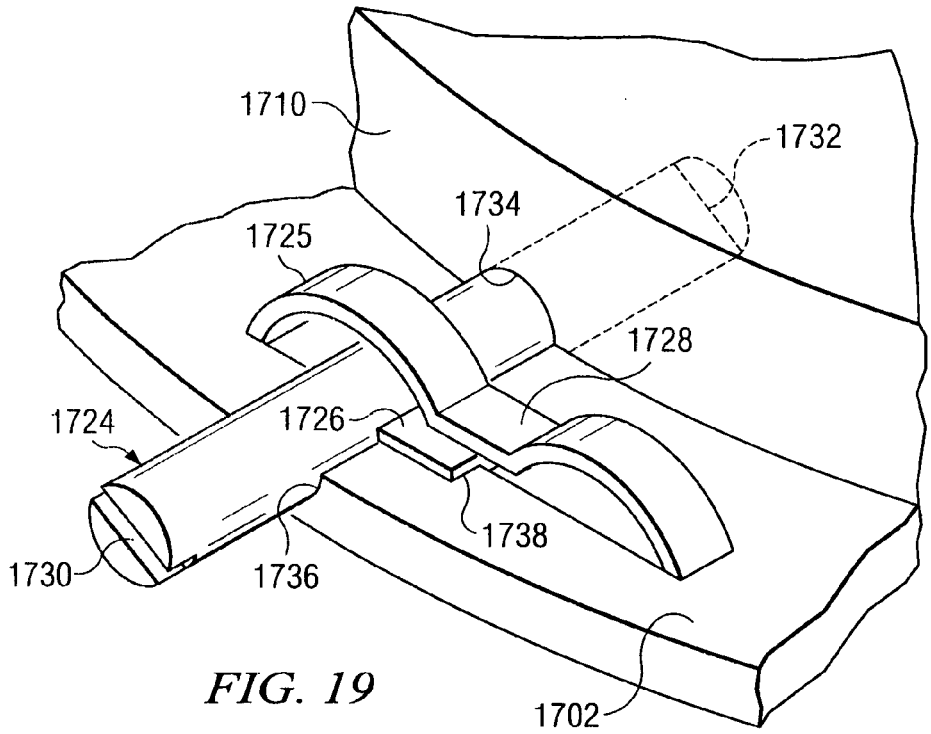
FIG. 19 is a partial isometric view of a locking pin and spring of an alternate preferred embodiment of the present invention.
Figure 20:
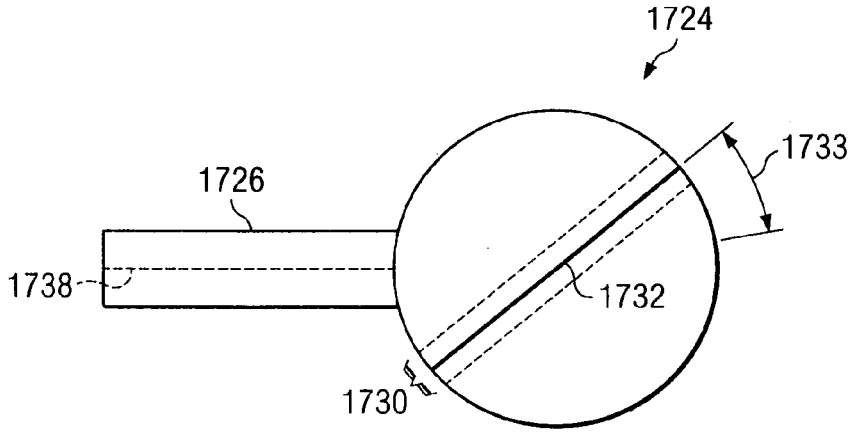
FIG. 20 is an elevation view of a locking pin of an alternate preferred embodiment of the present invention.
Figure 21:
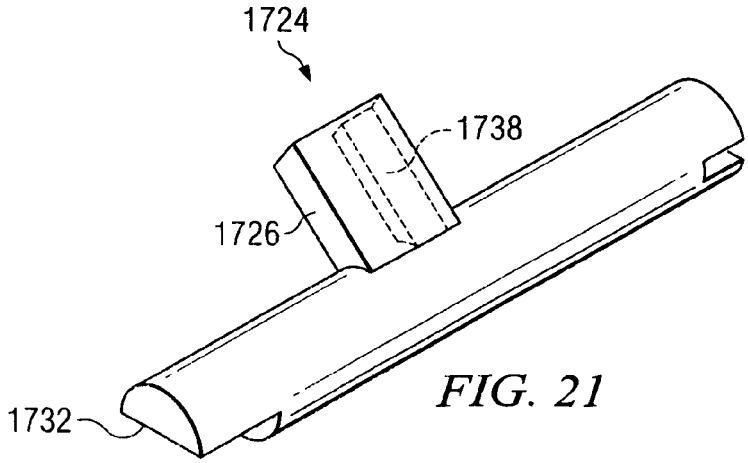
FIG. 21 is an isometric view of a locking pin of an alternate preferred embodiment of the present invention.

An alternate embodiment of the rotary coupling mechanism is shown in FIGS. 15-19. FIGS. 15 and 16 show wall bracket 1500. Wall bracket 1500 is generally a disk shape comprised of base 1502 and a centrally located protruding cone shape, boss 1504. Two diametrically opposed mounting holes 1518 and 1520 pass through base 1502 and have a beveled edge for countersinking flat head screws. Stop rib 1512 is a single protrusion located proximate the perimeter of base 1502. Diametrically opposed to stop rib 1512 is pin slot 1514 and pin stop 1516. Pin slot 1514 is a rectangular channel in wall bracket 1500. Pin slot 1514 includes incline 1515. Incline 1515 in an angled surface rising from the depth of pin slot 1514 to the surface of base 1502. Pin stop 1516 is an angled indention proximate one end of pin slot 1514 in the perimeter of wall bracket 1500. Flanges 1506, 1507, 1508, and 1509 extend from base 1502 creating slots 1530 in base 1502 under each flange. Slots 1530 pass completely through base 1502. Flanges 1506, 1507, 1508, and 1509 each have an angled mating surface 1522. In the preferred embodiment, the angle of mating surfaces 1522 can range from 1° to 5°.

Referring to FIGS. 17 through 21, base bracket 1700 and locking pin 1724 are shown. Base bracket 1700 is generally cylindrical in shape and is enclosed on one end by base housing 1710. Hole 1708 is concentric with and passes through base housing 1710. Lip 1702 extends outwardly from the open end of base bracket 1700. Included on lip 1702 are base holes 1704, 1705, 1706, and 1707. Base holes 1704, 1705, 1706, and 1707 are circular in shape and each includes a beveled perimeter on the underside of lip 1702. Spring 1728 is comprised of two arches connected by a flat rib. Spring 1728 extends from lip 1702 and is integrally formed with base bracket 1700. Pin channel 1736 is a radial groove in lip 1702 perpendicular to the perimeter of base housing 1710 and intersects pin hole 1734. Locking pin 1724 (FIG. 21) resides in pin channel 1736 and has integrally formed thereon a rectangular extension pin tab 1726. The cylindrical body of locking pin 1724 passes under first arch 1725 of spring 1728 through pin hole 1734 and into the interior of base bracket 1700. Pin tab 1726 is constrained by the flat rib of spring 1728. Pin tab 1726 includes notch 1738. Locking pin 1724 includes receptacle 1730 on one end. Receptacle 1730 is shaped to receive a torque transferring tool. Receptacle 1730 can be shaped to receive any number of tools capable of exerting a torsional force on locking pin 1724. In the preferred embodiment, a bladed screwdriver is used. Opposite receptacle 1730 on locking pin 1724 is pin face 1732. Pin face 1732 is a flat surface. Angle 1733 which is the angle of pin face 1732 relative to pin tab 1726 can range from about 20° to 40°. In the preferred embodiment, angle 1733 is about 30°. Base flanges 1716, 1717, 1718, and 1719 are L-shaped tabs that extend inwardly towards the interior of base bracket 1700 from base housing 1710. Slots 1742 in base housing 1710 are in alignment with each base flange. Slots 1742 are openings that pass completely through base housing 1710. Base flanges 1716, 1717, 1718, and 1719 each include an angled mating surface 1740. In the preferred embodiment, the angle of mating surfaces 1740 can range from 1° to 5°. Rib 1722 is connected to base flange 1717.

In use, wall bracket 1500 is secured to the wall with appropriate screws on molly bolts through mounting holes 1518 and 1520. Base bracket 1700 with locking pin 1724 residing in pin channel 1736 is secured to body 300 with screws inserted through base holes 1704, 1705, 1706, and 1707 and into stanchions 312, 313, 314, and 315 of body 300. Locking pin 1724 extends through cam slot 308 of body 300. To attach the base bracket to the wall bracket, base bracket 1700 with attached body 300 and cap 400 is placed over wall bracket 1500 and base flanges 1716, 1717, 1718, and 1719 of base bracket 1700 are oriented to pass between flanges 1506, 1507, 1508, and 1509 of wall bracket 1500. Simultaneously, pin face 1732 of locking pin 1724 is received in pin slot 1514. Base bracket 1700 is rotated until the base flanges of base bracket 1700 become under and adjacent to flanges 1506, 1507, 1508, and 1509 of wall bracket 1500. The angled surfaces 1522 of the flanges of wall bracket 1500 cooperate with the angled surfaces 1740 of the base flanges of base bracket 1700 and cause the base bracket to be secured with wall bracket 1500 into a locked position. Stop rib 1512 abuts rib 1722 and prevents over rotation of base bracket 1700 with respect to wall bracket 1500.

Figure 22A:
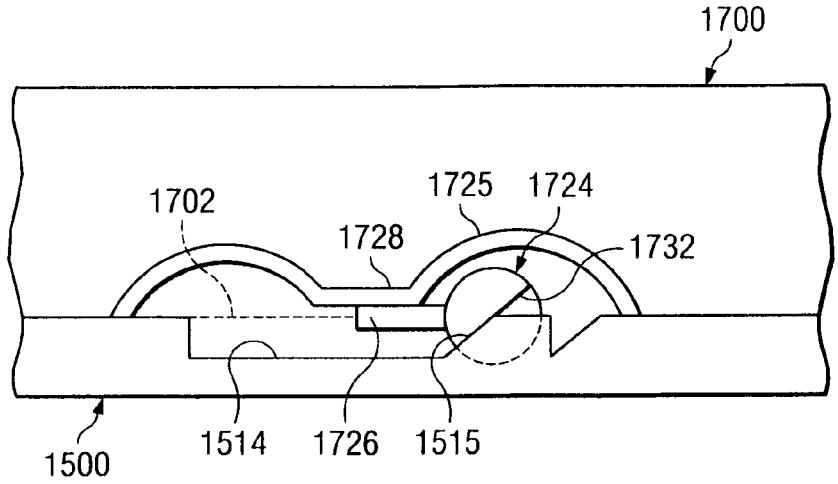
FIG. 22A is a partial elevation view showing the initial position of a locking pin relative to a wall bracket during installation of an alternate preferred embodiment of the present invention.
Figure 22B:
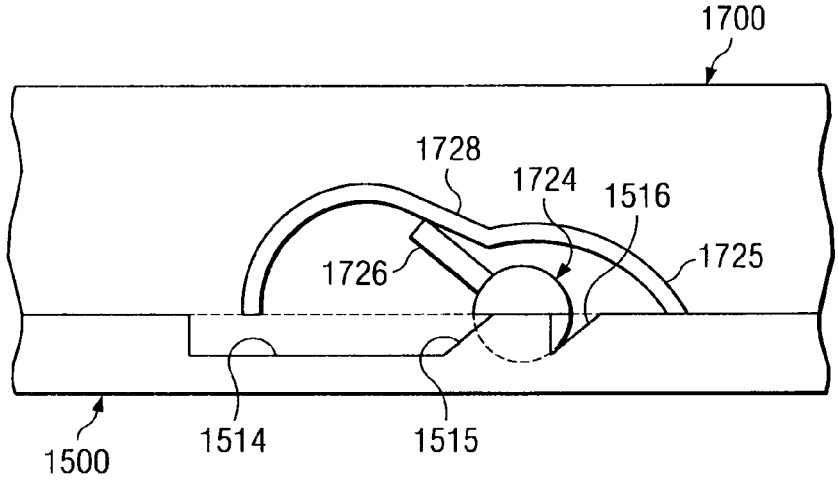
FIG. 22B is a partial elevation view showing the rotated position of a locking pin relative to a wall bracket during installation of an alternate preferred embodiment of the present invention.
Figure 22C:
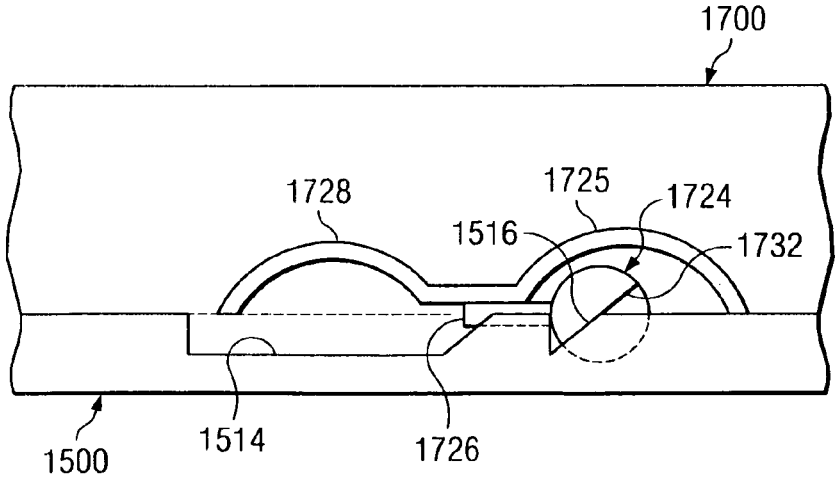
FIG. 22C is a partial elevation view showing the locked position of a locking pin relative to a wall bracket during installation of an alternate preferred embodiment of the present invention.

FIGS. 22A-22C show the position of locking pin 1724 as base bracket 1700 is rotated with respect to wall bracket 1500. The cylindrical body of locking pin 1724 remains under first arch 1725 during the rotational attachment of base bracket 1700 to wall bracket 1500. During the rotational attachment of the base bracket to the wall bracket, locking pin 1724 axially rotates as pin face meets incline 1515 and ultimately becomes adjacent to the angled surface of pin stop 1516.

As shown in FIG. 22A, pin tab 1726 is adjacent to and currently parallel with the flat rib of spring 1728 as rotation of the base bracket with respect to the wall bracket begins. Locking pin 1724 moves through pin slot 1514 until pin face 1732 becomes adjacent to incline 1515.

As can be seen in FIG. 22B, locking pin 1724 rotates as pin face 1732 slides up and over incline 1515. Pin tab 1726 deforms spring 1728 as locking pin 1724 rotates. In the preferred embodiment, a screwdriver is used to assist the rotation of locking pin 1724 against the bias of spring 1728.

FIG. 22C shows the base bracket and locking pin 1724 in a locked position relative to the wall bracket. In the locked position, pin face 1732 is adjacent and parallel with the angled surface of pin stop 1516 and pin tab 1726 is once again adjacent to and parallel with the flat rib of spring 1728.

To remove base bracket 1700 out of the locked position a torque transferring tool inserted into receptacle 1730 is used to rotate locking pin 1724 against the bias of spring 1728 and move pin face 1732 out of pin stop 1516 and back into pin slot 1514. When locking pin 1724 is in pin slot 1514, base 1700 is free to rotate off of wall bracket 1500.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A rotary coupling mechanism for attaching a household fixture to a wall comprising:

a first wall bracket affixed to the wall having a first set of flanges and a rim;

a first base bracket having a second set of flanges;

the first set of flanges engaging the second set of flanges when the first base bracket is rotated with respect to the first wall bracket;

a pin rotationally secured in the first base bracket, the pin having a cam surface, wherein the cam surface includes a set of teeth engaging the first set of flanges and the rim, thereby preventing rotation between the first wall bracket and the first base bracket; and, wherein the first wall bracket has a first perimeter and wherein the first set of flanges includes four flanges on the first perimeter where each flange has a first width that occupies between about 40° and 45° of the first perimeter.

2. The rotary coupling mechanism of claim 1 wherein the first base bracket has a second perimeter and wherein the second set of flanges includes three flanges each having a second width that occupies between about 35° and 40° of the second perimeter.

3. The rotary coupling mechanism of claim 1 wherein the first set of flanges engaging the second set of flanges provides a rotational adjustment between the first wall bracket and the first base bracket of about 15°.

4. The rotary coupling mechanism of claim 1 wherein the first base bracket further includes a brim having a set of attachment holes to attach a first hollow body.

5. The rotary coupling mechanism of claim 4 wherein the first hollow body includes an open end having a set of stanchions aligned with the set of attachment holes and further includes a closed end having a first bushing seated in a centrally located circular hole flanked by a first set of diametrically opposed dowel holes.

6. The rotary coupling mechanism of claim 5 wherein the first bushing is adjacent a first cap and includes a central port flanked by a second set of diametrically opposed dowel holes aligned with the first set of dowel holes.

7. The rotary coupling mechanism of claim 6 wherein the first cap includes a third set of dowel holes and is connected to the first hollow body with a shoulder bolt extending through the first hollow body, the first bushing, the first cap and into a catch in the first cap.

8. The rotary coupling mechanism of claim 7 wherein a set of dowels are seated in the first, the second, and the third sets of dowels preventing the first cap from rotating with respect to the first body and wherein the catch is releasably connected to a rod seated in a second cap adjacent a second bushing seated in a second body connected to a second base bracket engaged to a second wall bracket mounted on the wall.

9. A rotary coupling mechanism for attaching a household fixture to a wall comprising:

a wall bracket having a first set of flanges and a rim wherein the first set of flanges extend parallel to the rim;

a base bracket having a second set of flanges, an interior, and a brim defining a set of attachment holes;

a pin protruding into the interior and having a cam surface, the cam surface including a set of teeth and a first flat surface diametrically opposed and generally parallel to a second flat surface;

the base bracket rotationally engaged with the wall bracket wherein the first set of flanges is adjacent to the second set of flanges; and, the set of teeth lockingly engages one flange of the first set of flanges and the rim when the pin is rotated axially.

10. A pivoting paper holder for attachment to a wall comprising:

a first wall bracket having a first set of flanges and a first lip adjacent the first set of flanges;

a first base bracket having a second set of flanges removably engaged with the first set of flanges;

a first hollow cover having a closed end including a centrally located circular port and an open end connected to the first base bracket;

a first pin, inserted through the first cover and the first base bracket, having a first cam surface for engagement with the first wall bracket;

a first bushing seated in the circular port;

a first cap adjacent the first bushing and pivotally connected about a first bolt to the first cover;

a rod having a first end seated in the first cap and connected to the first bolt and having a second end releasably connected to an insert in a second cap;

a second bushing adjacent the second cap seated in a second cover;

the second cover connected to the second cap and the insert with a second bolt;

a second base bracket connected to the second cover;

a second wall bracket having a third set of flanges and a second lip;

the second base bracket having a fourth set of flanges removably engaged with the third set of flanges;

a second pin, inserted through the second cover and the second base bracket, having a second cam surface for engagement with the second wall bracket; and, a set of dowels, removably seated in the second cap and the second cover, preventing rotation of the second cap with respect to the second cover.

11. The pivoting paper holder of claim 10 wherein the first cam surface includes a first set of teeth for rotational engagement with the first set of flanges and the first lip.

12. The pivoting paper holder of claim 10 wherein the first set of flanges has a first set of mating surfaces and the second set of flanges has a second set of mating surfaces, wherein the first set of mating surfaces and the second set of mating surfaces are generally perpendicular to a longitudinal axis of the first bolt.

13. The pivoting paper holder of claim 10 wherein the second cam surface includes a second set of teeth for rotational engagement with the third set of flanges and the second lip.

14. The pivoting paper holder of claim 10 wherein the third set of flanges has a first set of mating surfaces and the fourth set of flanges has a second set of mating surfaces wherein the first set of mating surfaces and the second set of mating surfaces are generally perpendicular to a longitudinal axis of the second bolt.

* * * * *